US011284180B2

(12) United States Patent
Zhu

(10) Patent No.: US 11,284,180 B2
(45) Date of Patent: Mar. 22, 2022

(54) SAFE EARPHONE

(71) Applicant: Aidao Zhu, Zhejiang (CN)

(72) Inventor: Aidao Zhu, Zhejiang (CN)

( * ) Notice: Subject to any disclaimer, the term of this patent is extended or adjusted under 35 U.S.C. 154(b) by 0 days.

(21) Appl. No.: 16/616,457

(22) PCT Filed: May 23, 2018

(86) PCT No.: PCT/CN2018/087957

§ 371 (c)(1),
(2) Date: Nov. 23, 2019

(87) PCT Pub. No.: WO2018/214894

PCT Pub. Date: Nov. 29, 2018

(65) Prior Publication Data

US 2020/0169801 A1 May 28, 2020

(30) Foreign Application Priority Data

May 23, 2017 (CN) ..... 201710417231.6

(51) Int. Cl.
*H04R 1/00* (2006.01)
*H04R 3/00* (2006.01)
(Continued)

(52) U.S. Cl.
CPC ..... *H04R 1/1016* (2013.01); *G10K 11/1781* (2018.01); *H04R 1/08* (2013.01);
(Continued)

(58) Field of Classification Search
CPC ... H04R 1/00; H04R 1/02; H04R 1/08; H04R 1/083; H04R 1/10; H04R 1/1008;
(Continued)

(56) References Cited

U.S. PATENT DOCUMENTS

RE25,652 E * 10/1964 Kennedy ..... H04R 1/1016 381/380
5,327,506 A * 7/1994 Stites ..... H04R 25/43 381/355

(Continued)

FOREIGN PATENT DOCUMENTS

CN 101729955 A 6/2010
CN 202353778 U 7/2012

(Continued)

*Primary Examiner* — Thang V Tran
(74) *Attorney, Agent, or Firm* — Global IP Services; Tianhua Gu

(57) ABSTRACT

A safe earphone includes a wired safe earphone and an over ear safe headphone, having plurality of speakers with different frequency responses respectively used for two ears to listen, so the frequency response is particularly good; it is provided with a noise reduction signal conversion system which effectively converts the transmission of the active noise reduction frequency signal into the transmission of the passive audio signal and then restore to the transmission of the active audio signal after transmission of 1000 mm in length, therefore human body is isolated from radiation of communication at a long distance, which achieves a good a high degree of radiation protection, and solving the technical problem that the microphone of the existing radiation-proof earphone must be placed outside the air tube. Therefore, the invention is an excellent safe earphone achieving highly radiation-proof, having high sound quality and noise reduction function.

10 Claims, 7 Drawing Sheets

(51) Int. Cl.

| | |
|---|---|
| ***G10K 11/16*** | (2006.01) |
| ***H04R 1/10*** | (2006.01) |
| ***H04R 1/08*** | (2006.01) |
| ***G10K 11/178*** | (2006.01) |

(52) U.S. Cl.
CPC ..... *H04R 1/105* (2013.01); *H04R 1/1075* (2013.01); *H04R 1/1083* (2013.01); *H04R 3/00* (2013.01); *H04R 2201/10* (2013.01)

(58) Field of Classification Search
CPC .... H04R 1/105; H04R 1/1016; H04R 1/1075; H04R 1/1083; H04R 3/00; H04R 3/12; H04R 2201/10; G10K 11/16; G10K 11/175; G10K 11/187; G10K 11/1781
See application file for complete search history.

(56) References Cited

U.S. PATENT DOCUMENTS 5,732,143 A * 3/1998 Andrea et al. ..... A61F 11/14 381/72
8,130,995 B2 3/2012 Her et al.
2004/0082359 A1* 4/2004 Choi et al. ..... H04M 1/00 455/556.1
2005/0111687 A1* 5/2005 Lederer ..... H04R 1/1083 381/74
2006/0123527 A1* 6/2006 Porzelt ..... A61B 5/411 2/422
2011/0170730 A1* 7/2011 Zhu ..... H04R 1/1016 381/380
2012/0064845 A1* 3/2012 Smith ..... H04R 1/105 455/90.2
2012/0087510 A1* 4/2012 Sampimon ..... H04R 1/1083 381/74
2014/0294182 A1* 10/2014 Axelsson ..... H04R 1/1083 381/56
2014/0294191 A1* 10/2014 Parkins ..... A61F 11/14 381/72

FOREIGN PATENT DOCUMENTS

CN 203563171 U 4/2014
CN 204425632 U 6/2015
CN 205596282 U 9/2016
CN 107094273 A 8/2017

* cited by examiner

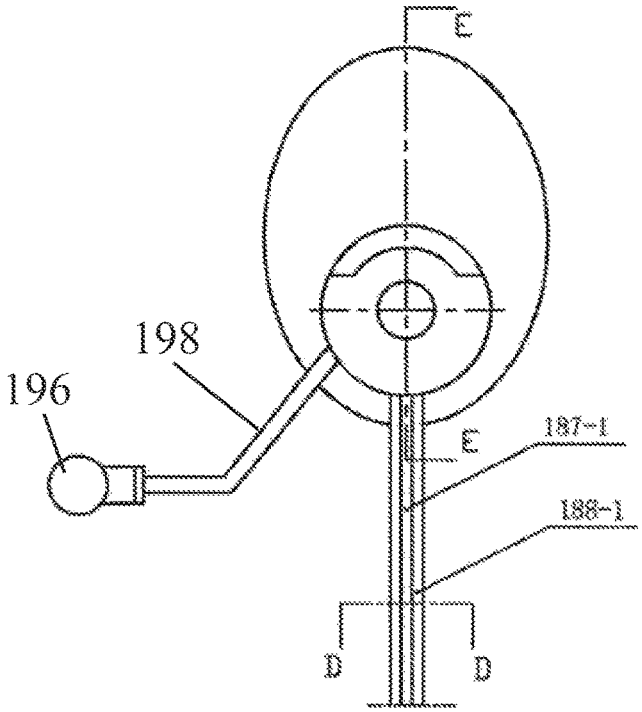
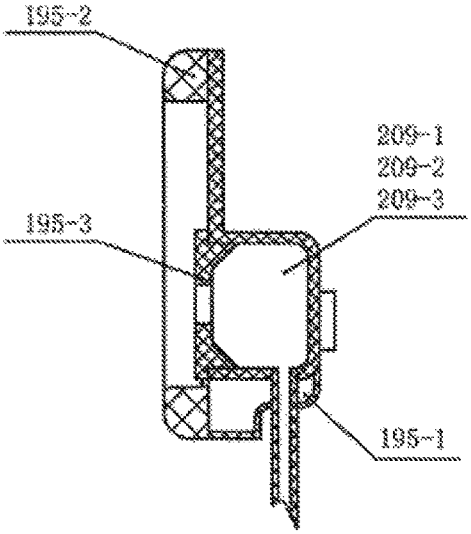
E-E
FIG. 5-2
D-D
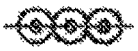
FIG. 5-1
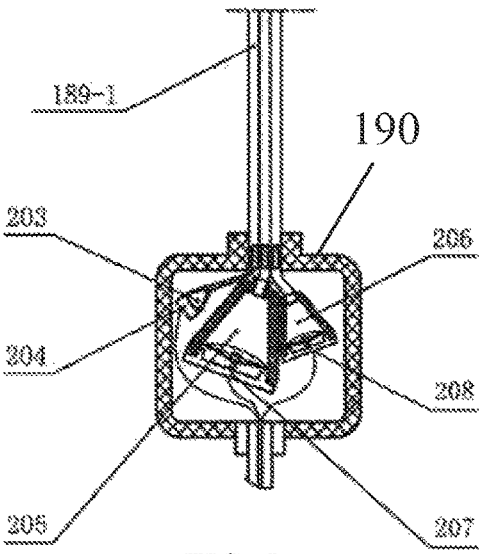
FIG. 5
D-D
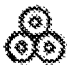
FIG. 5-4
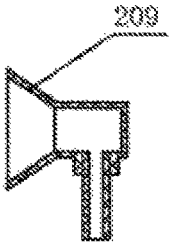
FIG. 5-3

SAFE EARPHONE

CROSS REFERENCE TO RELATED PATENT APPLICATION

The present application is the US national stage of PCT/CN2018/087957 filed on May 23, 2018, which claims the priority of the Chinese patent application No. 201710417231.6 filed on May 23, 2017, which applications are incorporated herein by reference.

FIELD OF THE INVENTION

The present invention relates to a radiation-proof or safe earphone device, and specifically to an anti-radiation earphone device and a stereo radiation-proof which are used for communication devices with high frequency magnetic field and intense radiation, such as a mobile phone.

BACKGROUND OF THE INVENTION

An existing radiation-proof earphone for instance, a product called as "radiation-free earphone" with patent number ZL02244828.4 can reduce electromagnetic radiation, however, its sound wave channel is only 5-10 cm and does not have metal shielded wire, which cannot reach the requirement of 2 mG or less. The purpose of being controlled as 2 mG or less is provided according to the theory of the inventor of the cell phone, Professor Shi Min of Taiwan Communication University, PhD of Stanford University in US, academician of American Academy of Engineering due to the harm to human by magnetic field. So the existing earphone cannot meet the requirement of anti-electromagnetic radiation as mentioned above. Meanwhile it has no sound cavity, thus frequency response is not good. The application No. 200810167226.5, entitled "Safe Earphone Device", applied by the present inventor, discloses five inventions of a safe earphone device and methods of achieving radiation-free and improving the sound quality which is granted patents from nine countries. But sound quality of the safe earphone this patent is not better than the ordinary earphones. The application is to disclose an earphone of which the sound quality is better than the ordinary earphones as well as improve radiation-proof effect, which achieve no radiation.

Therefore, people extraordinarily need an earphone device which can prevent electromagnetic radiation and have a better frequency response, and have a better stereo effect.

SUMMARY OF THE INVENTION

The present invention relates to a safe earphone which mainly includes a wired safe earphone and an over safe headphone, having plurality of speakers with different frequency responses respectively used for two ears to listen, so the frequency response is particularly good and better than the ordinary earphones; and setting up a noise reduction special solution, more importantly, it is provided with a noise reduction signal conversion system which effectively converts the transmission of the active noise reduction frequency signal into the transmission of the passive audio signal and then restore to the transmission of the active audio signal, which can make the passive audio transmission of the air tube be 1000 mm in length. Human body is isolated from radiation of communication at a long distance because of setting a metal shielded wire while a microphone is still kept at a close distance, which achieves a good noise reduction effect and a high degree of radiation protection as well as high sound quality and solving the technical problem that the microphone of the existing radiation-proof earphone must be placed outside the air tube. Because if the microphone is put too far away, the function of the microphone will be affected and its sound volume will be low.

The present invention is a good safe earphone device with highly anti-radiation ability and highly anti-noise sound quality.

A safe earphone comprising:

a loudspeaker device including: an ear cup (195,194), an ear cup casing (195-1, 195-2) having a sound cavity 209, the ear cup (194, 195) is arranged on the ear cup casing (195-1, 195-2), a sound collecting device including: a speaker housing (190), a left speaker (207) and a left sound collecting cavity (205) connected to the left speaker (207), a right speaker (208) and right sound collecting cavity (206) connected to the right speaker (208), a second microphone (204) and a taper-shaped sound cavity (203) connected to the second microphone (204);

a noise reduction device including: a noise reduction transmission arm (198), a noise reduction converter (196), the noise reduction converter (196) comprises a first noise reduction microphone (32-1 as FIG. 4) wired to a circuit of second or third audio amplifier, a speaker (32-2 as FIG. 4) is located in middle of the noise reduction transmission arm (198), the noise reduction device performs converting transmission from an active audio signal of the first microphone (32-1) into a passive audio signal;

a connection device including: a left ear air tube (187) for connecting the left sound collecting cavity (205) with the sound cavity (209), a right ear air tube (188) for connecting the right sound collecting cavity (206) with the sound cavity (209) and a microphone air tube 189 for connecting the taper-shaped sound cavity (203) with the sound cavity (209); the noise reduction transmission arm (198) for connecting the noise reduction converter (196) with the sound cavity (209); a sound outlet of the speaker (32-2) is connected to a sound collecting cavity then to the microphone air tube (189) and then to the taper-shaped sound cavity (203) of the second microphone (204); a plug (193) connecting with the second microphone (204) and a socket of communication devices.

A portable hand-held safe headset comprising a hand arm (230 as FIG. 6), a sound cavity (218), an air tube (220), a sound collecting cavity (222), a speaker (224), a microphone (223), a switch (231), a metal shielded wire (226) and a plug (225), the hand arm (230) has a receiver sound cavity (218) at its top, the sound cavity (218) has a top cover (228), the one end of the sound cavity (218) is connected to the one end of the air tube (220) of which the other end is connected to the small end of the sound collecting cavity (222), the big end of which is connected to the speaker (224), the wire of the speaker (224) and the wire of the microphone (223) are connected to the metal shielded wire (226) by the switch (231), the other end of the metal shielded wire (226) is connected to the plug (225).

A noise reduction portable hand-held safe headset, comprises a main body (230-1 as FIG. 10), a speaker (238), a sound collecting cavity (236), a sound cavity of taper shape (242), a second microphone (243), a metal shielded wire (245), a microphone air tube (240), a second audio amplifying circuit and a plug (246);

the underpart of the main body (230-1) is set with a noise reduction microphone signal conversion system, wherein the noise reduction microphone signal conversion system performs: converting the transmission from active audio signals from a first microphone (239) into passive audio signals, and setting the first microphone (239) wired to a second audio amplifying circuit to drive the speaker (238);

a sound outlet of the speaker (238) is connected to a big end of the sound collecting cavity (236), a small end of which is riveted to the one end of the microphone air tube (240), other end of which is connected to a small end of a sound cavity of the taper shape (242) of which a big end is connected to a sound receiving face of the second microphone (243), connections by the air tube (238) between the sound outlet of the speaker (238) and the sound receiving face of the second microphone (243) are sealed, other end of the second microphone (243) is wired to one end of the metal shielded wire (245) of which the other end is connected to the plug (246).

BRIEF DESCRIPTION OF THE DRAWINGS

FIG. 5 is a schematic view of structure of the noise reduction safe over ear headphone, having left and right ear sound wave channel, speakers and air tubes of microphone;

FIG. 5-1 is a schematic view of three air tubes parallelly bonded sides by sides;

FIG. 5-2 is a schematic view of the connection between the sound wave channel of the speaker and the sound cavity;

FIG. 5-3 is a schematic view of another kind of sound cavity;

FIG. 5-4 is a schematic view of three air tubes bonded together, having its cross-section shaped of triangle;

DETAIL DESCRIPTION OF THE PREFERRED EMBODIMENTS

Figure 1:
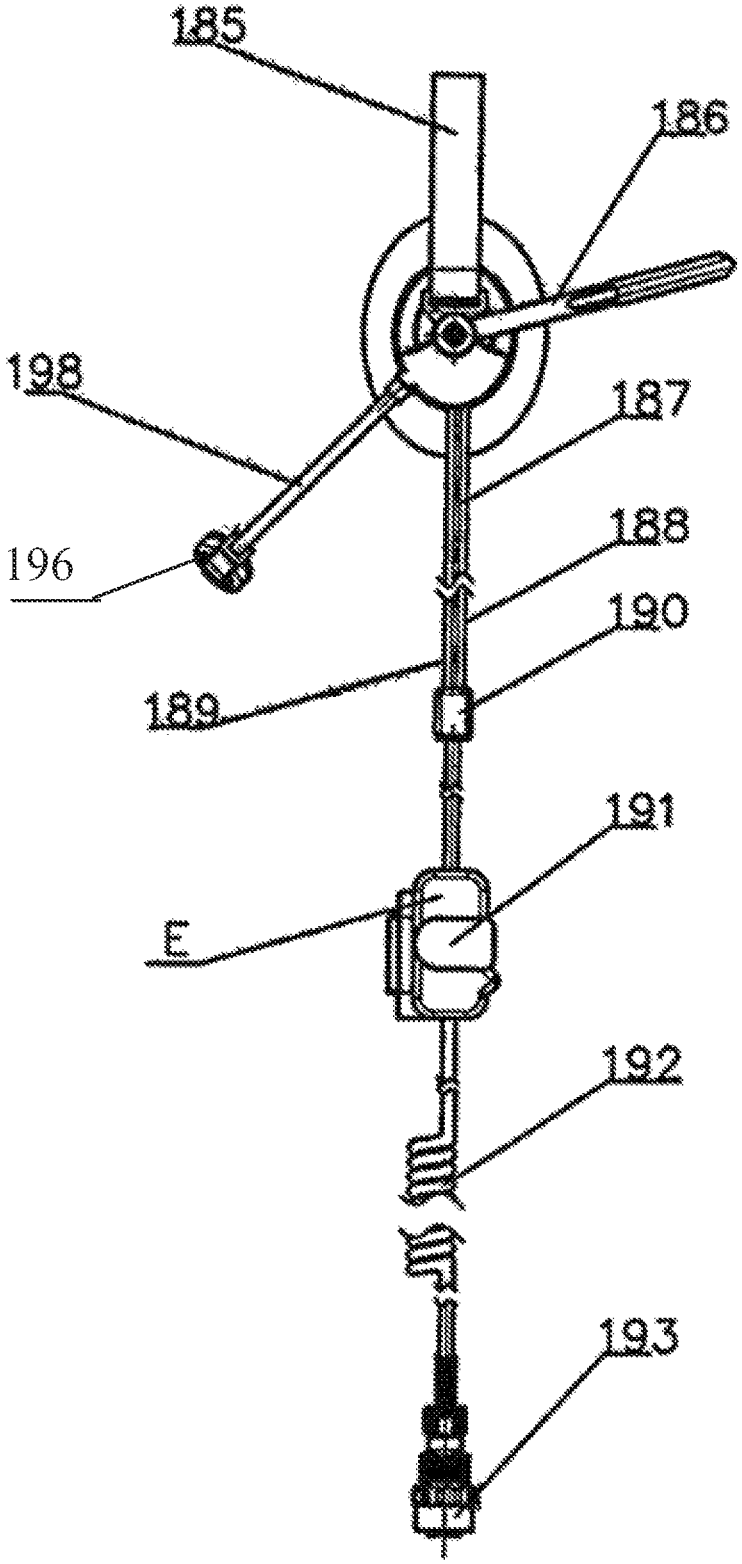
FIG. 1 is a side view of the noise reduction safe over ear headphone.

Embodiment 1 (FIGS. 1, 2, 3, 4 and 5)

The safe earphone as mentioned above:

The noise reduction safe over ear headphone in the present embodiment is provided with a left ear cup (195), a sound chamber casing (195-3 as FIG. 5-2), a left ear casing (195-1), a right ear cup (194), a right ear casing (195-2 as FIG. 5-2), a headband (185), a switch and its switch housing (191), a noise reduction transmission arm (198), and a noise reduction converter (196), a housing (195-1 as FIG. 5-2), a speaker housing (190 as FIG. 5), a plug (193), provided with a noise reduction conversion system: converts the transmission from the active audio signal into the passive audio signal, setting the first microphone (32-1 as FIG. 4) wired to the circuit of an audio amplifier (As FIG. 4) to push the speaker, the circuit is decided by the length and diameter of the selected air tube, the big end of the sound collecting cavity is connected to the sound outlets of the speaker (32-2 as FIG. 4) and the small end is riveted to the one end of microphone air tubes (188-1 as FIG. 5) (187-1) of which the other end is connected to the small end of the sound cavity (203 as FIG. 5) of taper shape, the big end of the sound cavity (203) is connected to the a sound receiving face of a second microphone (204 as FIG. 5), the connection from the sound outlets of the speaker through the air tube to the sound receiving face of the second microphone is sealed; the other end of the second microphone is wired to the one end of a metal shielded wire (192 as FIG. 1) of which and the other end is connected to the one end of the plug (193), the other end of which is connected to the socket of communication device.

Figure 4:
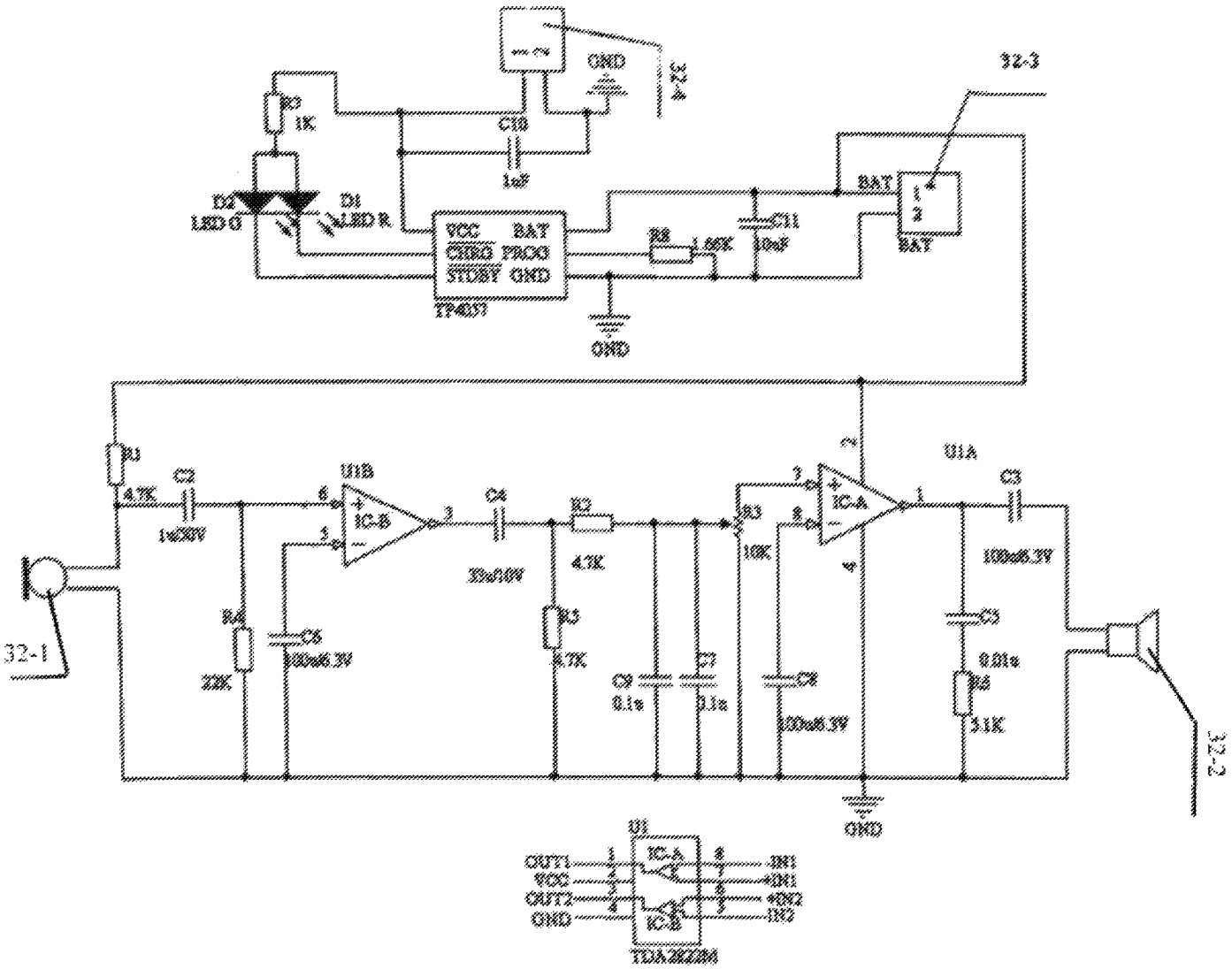
FIG. 4 is a circuit principle diagram of an audio converter that amplifies the audio signal of a microphone and convert it into a sound, and has a principle circuit of charging and power supply. The circuit can change the amplification power of the circuit according to the length of the microphone air tube to select different chips and different circuits.

The active part of the conversion system is provided with an electronic circuit board (as FIG. 4), a battery to supply power circuit and its elements, a charging circuit and a charging socket connected to the battery, a power LED and a power switch, the active signal elements of the aforesaid conversion system are all mounted in the converter, the speaker of the conversion system is mounted in the middle of the first microphone, or the outboard of the sound cavity inside the left ear housing, (as FIG. 4).

The signal transmission of the microphone is converted from active transmission into passive transmission then restore to active transmission again, which allows setting the air tube very long, and the microphone keeps at a very close distance to the sound outlet to achieve noise reduction, and meanwhile super-highly protect the ear and brain from the harm of communication devices.

Figure 2:
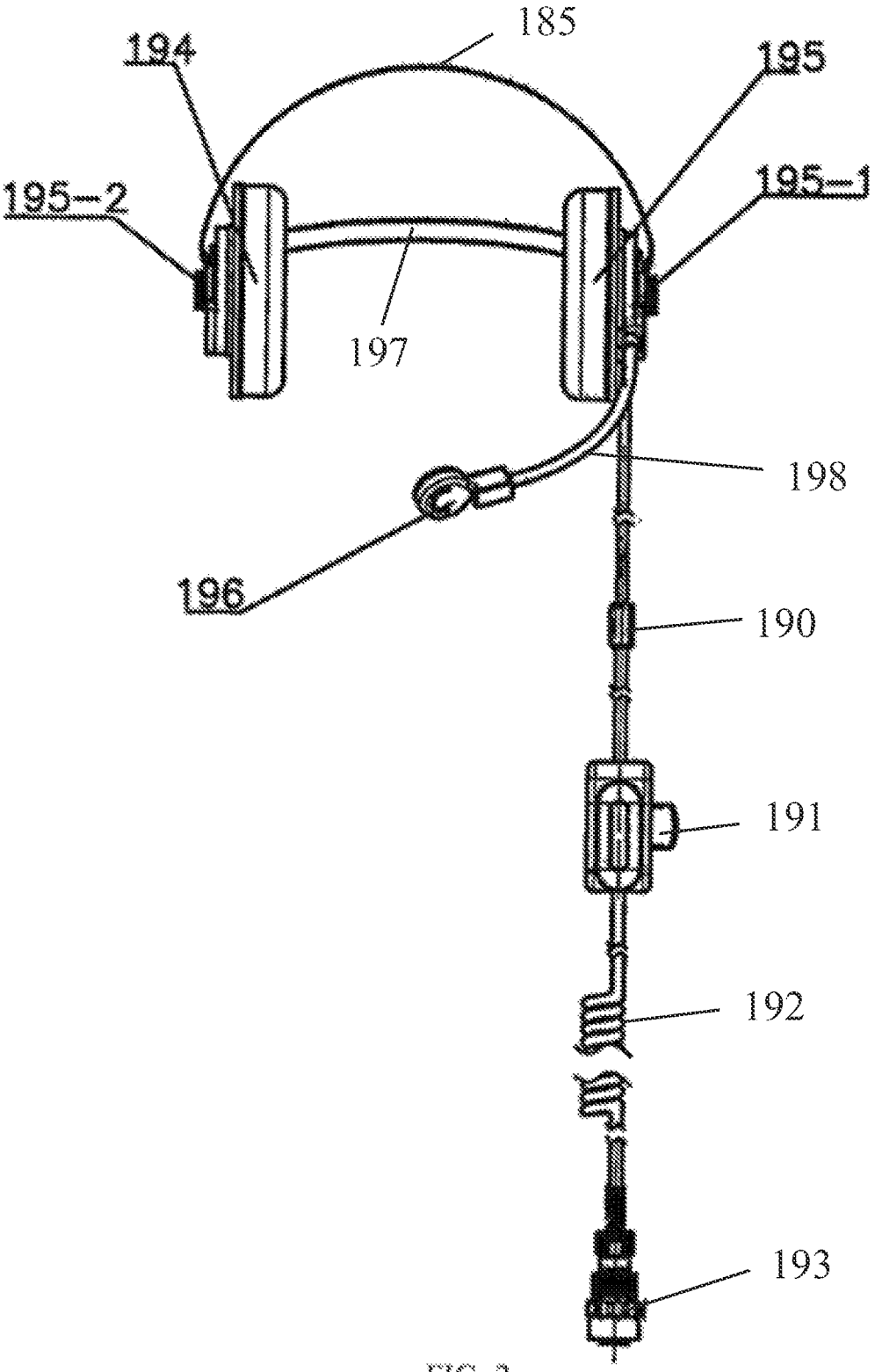
FIG. 2 is a front view of the noise reduction safe over ear headphone.
Figure 3:
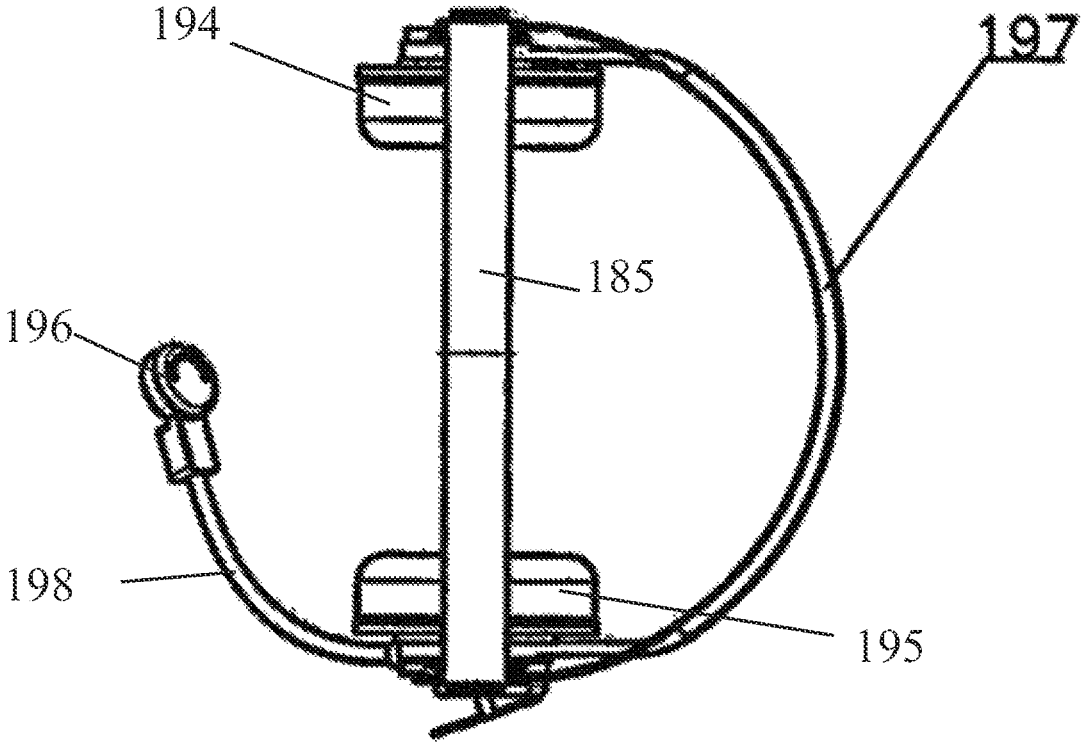
FIG. 3 is a top view of the noise reduction safe over ear headphone.

Refer to FIGS. 5 and 5-2, the one end of the left ear air tube (187-1) is connected to the inlet of the sound cavity (209-1) producing the sound, meanwhile the other end is connected to the small end of the sound collecting cavity (205) of which the big end of the sound collecting cavity is connected to the speaker (207), the other end of which is wired to the metal shielded wire (192 as FIG. 1); the one end of the right ear air tube (188-1) is connected to the entry of the right sound cavity producing the sound when the other end of the right air tube passes through the left ear casing (195-1) along the outboard of the metal headband (186 as FIG. 1), with the left ear air tube (187-1) parallel to the speaker casing (190) and is connected to the small end of the right ear sound collecting cavity (206), the other end of which is connected to the one end of a right ear speaker (208), the other end of the right ear speaker (208) is wired to the one end of metal shielded wire (192 as FIG. 1) through the switch (191 as FIG. 1), the other end of the metal shielded wire (192) is connected to the plug (193 as FIG. 1). The three air tube are parallelly bonded sides by sides, covered by flexible material outside.

Figure 7:
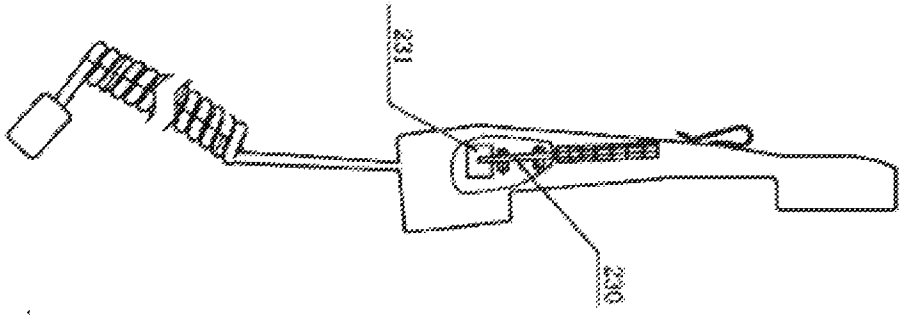
FIG. 7 is a schematic view of both of the appearance of the portable hand-held safe headset and the long pole switch.
Figure 6:
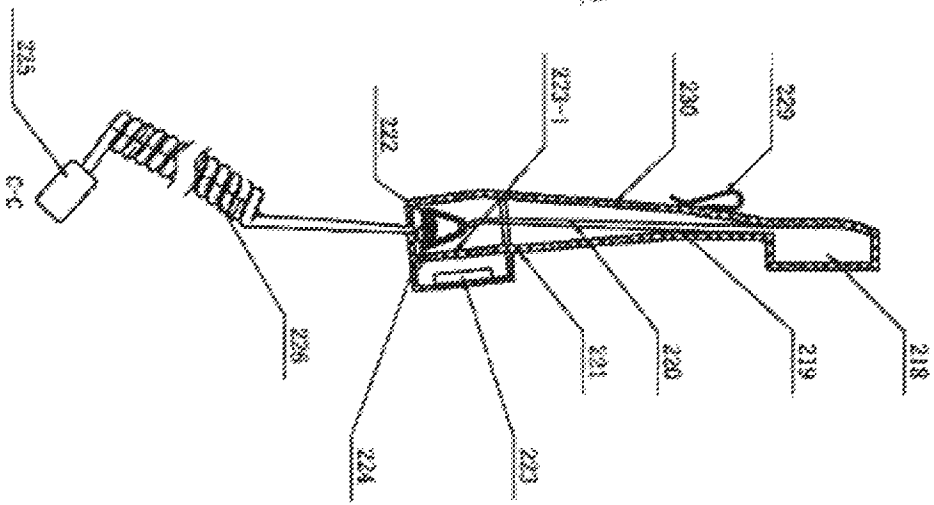
FIG. 6 is a full section view of the structure of the portable hand-held safe headset.
Figure 8:
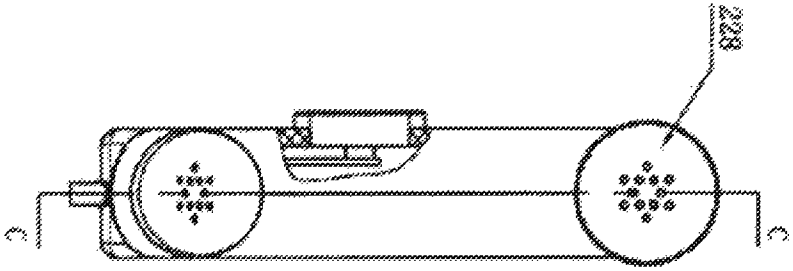
FIG. 8 is a schematic view of the structure of both of the appearance of the portable hand-held safe headset and a switch.

Embodiment 2 (FIGS. 6, 7 and 8)

The safe earphone as mentioned above:

A portable hand-held safe headset is provided with a hand arm (230) having a receiver sound cavity (218) with a top cover (228) at the top, the one end of the sound cavity (218) is connected to the one end of the air tube (220), meanwhile the other end of the air tube (220) is connected to the small end of the sound collecting cavity (222), the big end of the sound collecting cavity (222) is connected to the speaker (224), a connecting wire of the speaker (224) and the connecting wire of the microphone (223) are connected to the metal shielded wire (226) by the switch (231), the other end of the wire (226) is connected to the plug (225); The switch (231) is set at the side of the middle of the portable hand-held safe headset, a button of the switch (231) operates the electric switch by the mechanical transmission of the link to disconnect or connect the speaker (224) and microphone (223).

Figure 9:
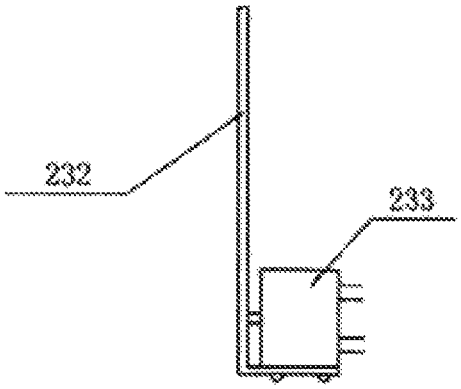
FIG. 9 is a schematic view of the structure of the switch, having the micro-switch away from the switch button.

Embodiment 3 (FIG. 9)

The safe earphone as mentioned above:

The present embodiment uses the top of the button of the switch pushing up a long arm (232) of a micro-switch (233) to disconnect or connect the micro-switch (233), other settings and structure keeps the same as embodiment 2, so that the active circuit is always kept at a distance from human brains, the microphone and the speaker are mounted in two cavities of which the sound is isolated from each other under the main body, the wire of the microphone is sealed with glue after passing through the separator, so that the arrangement can achieve a good anti-radiation effect.

Figure 10:
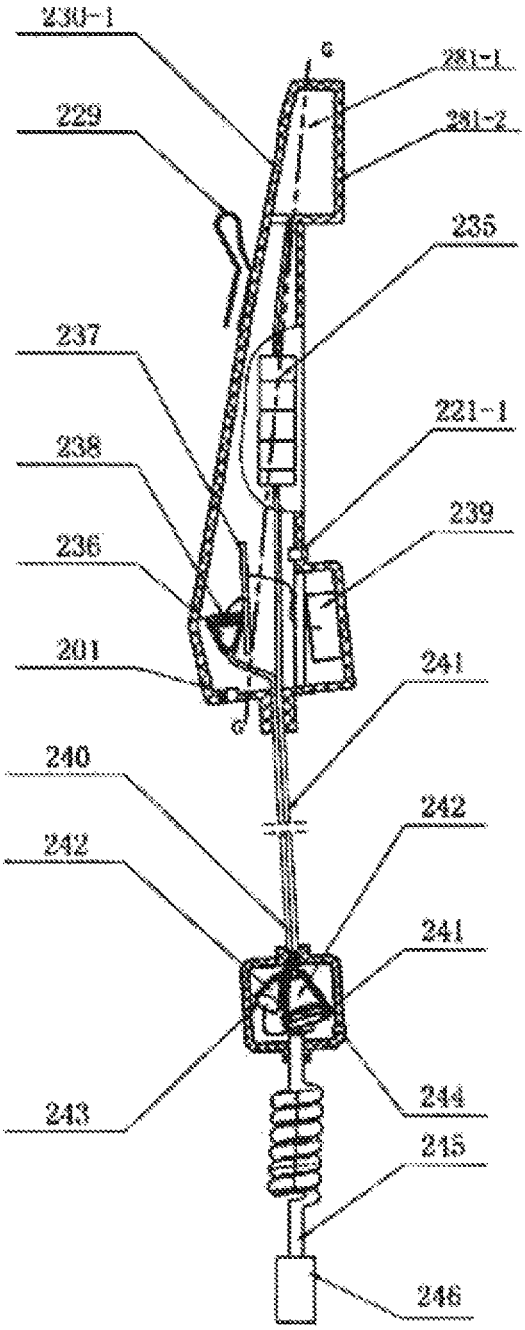
FIG. 10 is a schematic view of the permutation structure of the noise reduction portable hand-held safe headset.

Embodiment 4 (FIG. 10)

The safe earphone as mentioned above:

The underpart of the main body (230-1) of the noise reduction portable hand held safe headset is provided with a noise reduction microphone signal conversion system: converting the transmission from the active audio signal into passive audio signal, and sets the first microphone (239) wired to a second audio amplifying circuit to drive the speaker (238), the sound outlet of the speaker (238) is connected to the big end of the sound collecting cavity (236), the small end of which is riveted to the one end of a microphone air tube (240), the other end of the microphone air tube (240) is connected to the small end of the taper-shaped sound cavity (243) of which the big end is connected to the sound receiving face of the second microphone, the connection between the sound outlet of the microphone and the sound receiving face of the second microphone is sealed, the other end of the second microphone (243) is wired to the one end of the metal shielded wire (245) of which the other end is connected to the plug (246);

The active part of the conversion system is provided with a battery to supply the power circuit and its elements, a charging circuit connected with battery and a charging socket and its LED, the speaker (238) and the first microphone (239) are separately mounted in the two cavities of which the sound is isolated from each other inside the main body (230-1), the wire of the first microphone is sealed with glue after passing through the separator.

The second microphone (243) and the speaker (241) are disposed in the casing (230-2) and are separated by a sound baffle, the sound receiving face of the speaker (241) is connected to the big end of the sound collecting cavity (242), the small end of which is connected to the air tube of the speaker (241). The other end of the air tube of the speaker is connected to the one end of a sound cavity (281-1). The speaker (241) is wired to the one end of a metal shielded wire (245), the other end of which is connected to the plug (246).

What is claimed is:

1. A safe earphone comprising:

a loudspeaker device including:

an ear cup (195,194), an ear cup casing (195-1, 195-2) having a sound cavity 209, the ear cup (194, 195) is arranged on the ear cup casing (195-1, 195-2), a sound collecting device including:

a speaker housing (190), a left speaker (207) and a left sound collecting cavity (205) connected to the left speaker (207), a right speaker (208) and a right sound collecting cavity (206) connected to the right speaker (208), a second microphone (204) and a taper-shaped sound cavity (203) connected to the second microphone (204);

a noise reduction device including:

a noise reduction transmission arm (198), a noise reduction converter (196), the noise reduction converter (196) comprises a first noise reduction microphone (32-1) wired to a circuit of second or third audio amplifier, a speaker (32-2) is located in middle of the noise reduction transmission arm (198), the noise reduction device performs converting transmission from an active audio signal of the first microphone (32-1) into a passive audio signal;

a connection device including:

a left ear air tube (187) for connecting the left sound collecting cavity (205) with the sound cavity (209), a right ear air tube (188) for connecting the right sound collecting cavity (206) with the sound cavity (209) and a microphone air tube 189 for connecting the taper-shaped sound cavity (203) with the sound cavity (209);

the noise reduction transmission arm (198) for connecting the noise reduction converter (196) with the sound cavity (209); a sound outlet of the speaker (32-2) is connected to a sound collecting cavity then to the microphone air tube (189) and then to the taper-shaped sound cavity (203) of the second microphone (204);

a plug (193) connecting with the second microphone (204) and a socket of communication devices.

2. The earphone according to claim 1, wherein the left sound collecting cavity (205) has a big end connecting with the left speaker (207) and a small end connecting with the left ear air tube (187); the right sound collecting cavity (206) has a big end connecting with the right speaker (208) and a small end connecting with the right ear air tube (188); the taper-shaped sound cavity (203) has a big end connecting with the second microphone (204) and a small end connecting with the microphone air tube (189).

3. The earphone according to claim 2, wherein the ear cup includes a left ear cup (195) and a right ear cup (194), the ear cup casing includes a left ear casing (195-1) and a right ear casing (195-2), the left ear cup (195) is arranged on the left ear casing (195-1), the right ear cup (194) is arranged on the right ear casing (195-2), the left ear casing (195-1) and the right casing (195-2) are connected by a headband (185).

4. The earphone according to claim 3, wherein further comprises a metal bow (186) connecting the left ear casing (195-1) and the right ear casing (195-2).

5. The earphone according to claim 2, wherein the ear cup (195, 194) comprises a left ear cup (194) including a left ear sound cavity and a right ear cup (195) including a right sound cavity, the left sound cavity is connected to the small end of the left sound collecting cavity (205) by the left ear air tube (187-1), the right sound cavity is connected to the small end of the right sound collecting cavity (206) by the right ear air tube (188-1); the right ear air tube (188-1) is connected to the small end of the right ear sound collecting cavity (206) along the outer edge of the metal bow (186) after passing through the left ear casing (195-1).

6. The earphone according to claim 1, the sound collecting cavities (204, 205, 206) have a taper shape with an cone angle between 9° and 130°.

7. A portable hand-held safe headset comprising a hand arm (230), a sound cavity (218), an air tube (220), a sound collecting cavity (222), a speaker (224), a microphone (223), a switch (231), a metal shielded wire (226) and a plug (225), the hand arm (230) has a receiver sound cavity (218) at its top, the sound cavity (218) has a top cover (228), the one end of the sound cavity (218) is connected to the one end of the air tube (220) of which the other end is connected to the small end of the sound collecting cavity (222), the big end of which is connected to the speaker (224), the wire of the speaker (224) and the wire of the microphone (223) are connected to the metal shielded wire (226) by the switch (231), the other end of the metal shielded wire (226) is connected to the plug (225).

8. The portable hand-held safe headset according to claim 7, wherein the switch (231) is disposed at side of middle of said earphone, a button of the switch (231) disconnects or connects the speaker (224) and the microphone (223) by operating the mechanical transmission of a linkage.

9. The portable hand-held safe headset according to claim 7, wherein further comprises a micro-switch (233) with a long arm (232), the button of the switch (232) pushes up a long arm (232) of the micro-switch (233) to connect or disconnect the micro-switch (233).

10. A noise reduction portable hand-held safe headset, comprises a main body (230-1), a speaker (238), a sound collecting cavity (236), a sound cavity of taper shape (242), a second microphone (243), a metal shielded wire (245), a microphone air tube (240), a second audio amplifying circuit and a plug (246);

the underpart of the main body (230-1) is set with a noise reduction microphone signal conversion system, wherein the noise reduction microphone signal conversion system performs:

converting the transmission from active audio signals from a first microphone (239) into passive audio signals, and setting the first microphone (239) wired to a second audio amplifying circuit to drive the speaker (238);

a sound outlet of the speaker (238) is connected to a big end of the sound collecting cavity (236), a small end of which is riveted to the one end of the microphone air tube (240), other end of which is connected to a small end of a sound cavity of the taper shape (242) of which a big end is connected to a sound receiving face of the second microphone (243), connections by the air tube (238) between the sound outlet of the speaker (238) and the sound receiving face of the second microphone (243) are sealed, other end of the second microphone (243) is wired to one end of the metal shielded wire (245) of which the other end is connected to the plug (246).

* * * * *